US006855230B2

(12) United States Patent
Salminen et al.

(10) Patent No.: US 6,855,230 B2
(45) Date of Patent: Feb. 15, 2005

(54) METHOD AND REGULATION ARRANGEMENT FOR CONTROLLING DEWATERING PROFILE OF A FORMER

(75) Inventors: Kari I. Salminen, Ylinen (FI); Pasi Virtanen, Valkeakoski (FI); Jukka Sorsa, Tampere (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/297,551

(22) PCT Filed: Jun. 8, 2001

(86) PCT No.: PCT/FI01/00544

§ 371 (c)(1),
(2), (4) Date: Jul. 3, 2003

(87) PCT Pub. No.: WO01/98581

PCT Pub. Date: Dec. 27, 2001

(65) Prior Publication Data

US 2004/0011488 A1 Jan. 22, 2004

(30) Foreign Application Priority Data

Jun. 12, 2000 (FI) ..... 20001391

(51) Int. Cl.[7] ..... D21F 11/00; D21F 13/00

(52) U.S. Cl. ..... 162/198; 162/263; 162/252; 162/259; 162/300; 162/301; 162/203; 73/159

(58) Field of Search ..... 162/198, 252, 162/263, 301, 259, 300, 203; 73/159

(56) References Cited

U.S. PATENT DOCUMENTS 5,530,346 A 6/1996 Varpula et al.

5,552,021 A 9/1996 Illvespaa et al.

FOREIGN PATENT DOCUMENTS

| | | |
|---|---|---|
| FI | 92940 | 10/1994 |
| FI | 103995 | 12/1994 |
| WO | WO 01/98581 | 12/2001 |

OTHER PUBLICATIONS

Translation of Finnish Patent Application No. 942027, corresponding to Finnish Patent No. 103995; Dec. 1994.
Translation of Finnish Patent Application No. 932793, corresponding to Finnish Patent No. 92940; Oct. 1994.
Search Report issued in Finnish Priority Application No. 20001391.
International Search Report issued in International Patent Application No. PCT/FI01/00544.
International Preliminary Examination Report issued in International Patent Application No. PCT/FI01/00544.

*Primary Examiner*—Mark Halpern
(74) *Attorney, Agent, or Firm*—Stiennon & Stiennon

(57) ABSTRACT

In a paper or board machine, the cross-direction profile of a flow channel defined between a first dewatering element (52, 53) situated inside a first forming wire loop (50) and a second dewatering element (64, 65) situated inside a second forming wire loop (60) is measured, and the location and/or the position of the blade element (64, 65) is adjusted based on the measurement result in order to regulate the thickness profile of a stock flow. The measurement can be by passing an alternating current of low frequency to a current rail situated in the second dewatering element (64, 65) and by measuring the strength of the magnetic field created by it by at least two measuring devices which have been placed either in the first dewatering element (53) or, when the first dewatering element is a forming roll (52), in the same dewatering element (64) as the current rail.

8 Claims, 2 Drawing Sheets

METHOD AND REGULATION ARRANGEMENT FOR CONTROLLING DEWATERING PROFILE OF A FORMER

CROSS REFERENCES TO RELATED APPLICATIONS

This application is a U.S. national stage application of International Application No. PCT/F101/00544, filed Jun. 8, 2001, and claims priority on Finnish Application No. 20001391 filed Jun. 12, 2000, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method for controlling the dewatering profile in a former of a paper or board machine, in which method water is removed from a web between two forming wire loops, inside which forming wire loops dewatering elements have been placed of which at least one comprises a blade element which extends transversely across the web with respect to the running direction of the wires.

The invention also relates to a regulation arrangement for controlling the dewatering profile in a former of a paper or board machine, which former comprises two forming wire loops having dewatering elements placed inside them, of which elements at least one comprises a blade element which extends transversely across the web with respect to the running direction of the wires and is in contact with one of the forming wires.

Dewatering in the drainage area of a twin-wire former depends, among other things, on the quality of wires, the dewatering elements used, dewatering pressure (tension of wires on curved surfaces) as well as on drainage distance. As dewatering elements are generally used, among other things, forming rolls, forming shoes and dewatering boxes, the dewatering effect of which can be further enhanced by means of blade elements placed on the opposite side of the web, the function of which blade elements can be to doctor water from the surface of the wire, generate pressure pulses in the web which is being formed and/or guide the run of the web. If the flow channel defined between the surface of a dewatering element and a blade element placed on the opposite side of the web is filled with water and if said elements are not totally parallel over their entire length, the thickness of the stock suspension layer is not uniform at them across the entire width of the web. In that connection, lateral flows readily occur in the stock, which flows may cause problems in various property profiles of the paper that is being manufactured. Initially, attempts are made to mount the dewatering and blade elements straight, but measurements or regulations are generally not performed any more during running of the paper machine. The problems associated with the dewatering profile are aggravated when the former is run with large flow volumes and there are dewatering elements on both sides of the web. As a result, there may be problems both in the basis weight profile of paper and in its fibre orientation profile. In practice, it is very difficult to distinguish whether the cause of the problems is the headbox or the dewatering elements disposed after it.

In order to achieve good formation and to control the basis weight, moisture content and dewatering in the cross direction of the web, it would be important to know the liquid amount between the wires and its flow rate profile in the web former. The thickness profile of the stock flow in the former cannot be directly measured by the present methods.

FI patents 92940 and 103995 describe regulation arrangements for controlling cross-direction property profiles of a paper web manufactured on a twin-wire former. Water is removed from the paper web after a forming gap under compression between two forming wires utilising dewatering and/or forming ribs or blades whose deflection is regulated in the cross direction of the machine, thereby affecting the cross-direction retention profile of the web. In the method, a cross-direction property profile, such as the fibre orientation profile, filler profile, basis weight profile and/or slice profile of the paper web being manufactured is/are measured, and the deflection of loading blades is regulated based on the measurement signals. Thus, the actual thickness profile of the stock flow at the blades is not monitored in the method, but the regulation of the deflection of the blades is based on control signals derived from elsewhere.

U.S. Pat. No. 5,530,346 describes a method and a device for contact-free measurement of the size and shape of a slot, and it is mentioned that one application of the method is measurement of the height and profile of a headbox slice. A current conductor is arranged at the edge of the slot to be measured, to which conductor an alternating current of low frequency is passed. The conductor produces a magnetic field around it and the strength of the magnetic field is measured by means of magnetometers attached to the opposite edge of the slot. The height and the shape of the slot are calculated based on the strength of the magnetic field. The document describes a mere measurement method but not the use of the measurement result as a control signal.

SUMMARY OF THE INVENTION

The aim of the invention is to improve control of the dewatering profile in a former of a paper or board machine.

In the method, the distance between two dewatering elements is measured, which dewatering elements are inside opposing wire loops. Usually, one of said dewatering elements is a blade element or includes blade elements. The location and/or the position of the blade element in relation to the opposing dewatering element is/are adjusted based on the measured distance profile in order to regulate the thickness profile of the stock flow.

In other words, the dewatering profile is regulated based on the actual measured height of the dewatering channel. Advantageously, measurement is accomplished by means of the electronics and apparatus disclosed in U.S. Pat. No. 5,530,346 such that a current rail and the devices for measurement of a magnetic field are placed in dewatering elements of a twin-wire zone. The direction-dependence of a magnetometer is utilised in the measurement of the magnetic field such that only the distance between a dewatering element and the current rail is measured. In the cross direction of the machine, the number of measurement points can be freely selected such as is suitable for the other geometry of the former. The current rail and the magnetometers are placed either on different sides or on the same side of the web in the dewatering element best suited for measurement. When, for example, the distance between a single blade of a set of loading blades and a ribbed deck of a dewatering box is measured, the current rail can be placed in the loading blade and the devices measuring the strength of the magnetic field can be placed in the dewatering box, or vice versa. When the distance between a forming roll and a blade element pressed against it is measured, both the current rail and the devices for measuring the magnetic field are placed on the side of the blade element to measure the strength of the magnetic field which the roll rotating close to the current rail creates around it.

The dewatering profile can be measured immediately after the headbox at the first forming roll or at a later stage, for example, at a dewatering box. The measurement of the profile can be carried out at as many successive locations as desired, which makes it possible to monitor the development of the dewatering profile while the web moves forward in the former. For measurement of the dewatering profile, it is also possible to fit a mere beam without suction and a blade element on the opposite side of it, in which connection a measurement result is obtained for use in regulation of the dewatering profile. The location and/or the position of the blade element participating in measurement is advantageously adjusted based on the measurement profile of the flow channel, but in some instances adjustment can be applied to some other blade element in the former, for example, when there are several measurement points in succession in the former.

The adjustment to be made on the basis of the profile measurement can be accomplished in several different ways either mechanically or thermally. As adjustment actuators it is possible to use mechanical gears by which the support structure of the blade element is inclined in the cross direction of the machine. It is also possible to use a thermal compensation system by which the support structure of the blade element is bent thermally. One arrangement of this kind has been described in FI patent 92940. Alternatively, it is possible to bend only a single blade element while the support structure remains stationary. One arrangement of this kind suitable for adjustment of the cross-direction deflection of loading blades has been described in FI patent 103995.

In this connection, by the term "dewatering element" is meant both the elements conveying water out of the web, such as dewatering boxes and forming rolls, and single blade elements or blade elements arranged in a group, which may be dewatering blades, loading blades or other blades guiding the run of the wires in a twin-wire dewatering zone.

BRIEF DESCRIPTION OF THE DRAWINGS

In the following, the invention will be described with reference to the accompanying FIGS. 1–4, to the details of which the invention is, however, not meant to be narrowly confined.

DESCRIPTION OF THE PREFERRED EMBODIMENTS

Figure 1:
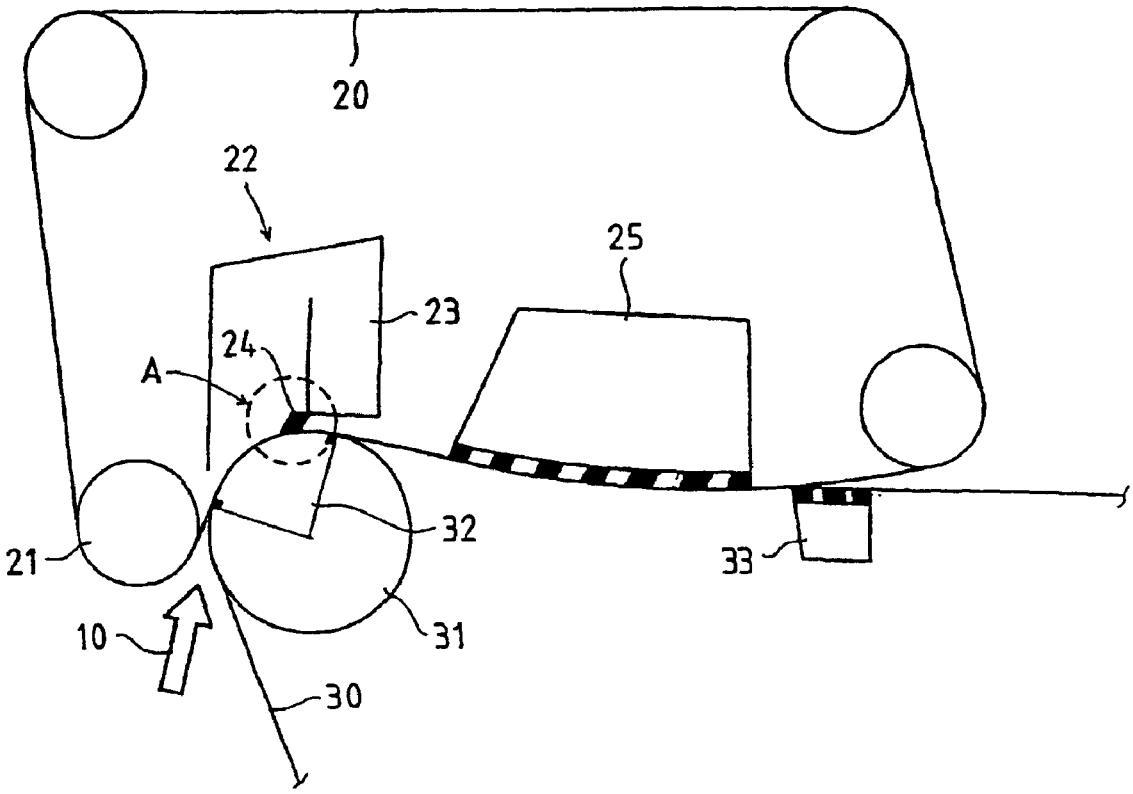
FIG. 1 shows a roll-gap former in which the method according to the invention can be applied.

FIG. 1 shows a roll-gap former in which a stock suspension jet is discharged from a headbox 10 into a gap between two forming wires 20 and 30. The geometry of the forming gap is defined, on the one hand, by a breast roll 21 guiding the run of an upper wire loop 20 and, on the other hand, by a forming roll 31 which has been placed inside a lower wire loop 30 and over which the joint run of the wires 20, 30 curves. Inside the forming roll 31 there is a vacuum zone 32 in the region of the curve sector of the wires 20, 30 and in the same region above the forming roll 31 there is a suction deflector unit 22 comprising a suction chamber 23 connected to a vacuum source as well as a water deflector blade 24, which guides the water drained onto the upper surface of the wire 20, aided by the kinetic energy of the water and by the vacuum prevailing in the suction deflector unit 22, into the suction chamber 23. After the curve sector of the forming roll 31 there are conventional dewatering elements, such as a forming shoe 25 disposed inside the upper wire loop 20 and a suction flatbox 33 situated inside the lower wire loop 30.

In accordance with the basic idea of the invention, the distance between the surface of the forming roll 31 and the dewatering blade 24 is measured in a contract-free manner in the gap former of FIG. 1, thereby establishing the thickness profile of the stock flow at this location. Based on the measurement result, the location and the position of the dewatering blade 24 and possibly of the entire suction deflector unit 22 are adjusted with respect to the forming roll 31.

Figure 2:
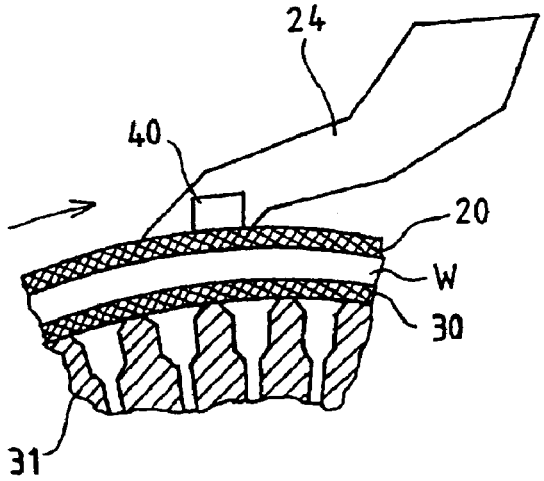
FIG. 2 shows a detail A from FIG. 1.

FIG. 2 shows an enlargement of a detail A in FIG. 1. The forming roll 31 and the water deflector blade 24 define between themselves a flow channel in which the wires 20 and 30 and the stock suspension W discharged between them from the headbox 10 move forwards. The front edge of the water deflector blade 24 doctors water that has drained from the stock suspension W onto the outer surface of the upper wire 20 and guides it further into the suction chamber. For measuring the height of the flow channel, a current rail 40 has been embedded inside the water deflector blade 24, which current rail extends from one end of the water deflector blade to the other end of it and to which an alternating current of low frequency is passed from a current source (not shown). The alternating current induces around the current rail 40 an alternating magnetic field whose strength at each point is inversely proportional to the distance of the point in question from the current rail 40. In connection with the water deflector blade 24 there are disposed at least two magnetometers (not shown) at suitable distances from one another in the cross direction of the machine, which magnetometers have been arranged to measure the strength of the magnetic field which the forming roll 31 rotating in the magnetic field created by the current rail 40 generates around it. The cross-direction profile of the flow channel defined between the forming roll 31 and the blade element 24 is calculated based on the measurement results, said profile representing the thickness profile of the stock flow at this location.

The rotating forming roll made of a magnetic metal imposes special requirements of its own for the measurement of the thickness profile of the flow channel. The square-wave-shaped alternating current of slow frequency passed to the current rail 40 creates around the current rail 40 a magnetic field that is dependent on distance. A field represented by an equivalent current rail is also generated in the shell of the forming roll 31 when it rotates. Since the magnetic properties of the shell are much greater than those of air, the magnetic field penetrates the surface practically at an angle of 90° according to the law of refraction. This kind of situation can be represented by an equivalent current rail which is equally far from the surface of the shell as the current rail proper but in another direction. Measurement of a magnetic field is, as known, direction-sensitive. Thus, if detectors are placed in the dewatering element such that the magnetic field created by the current rail 40 does not pass through the magnetometers, then the component which remains to be measured is the magnetic field created by the roll 31, which field is directly proportional to the distance between the roll surface and the magnetometer. Contact-free measurement of the distance between the surface of the roll 31 and the dewatering element 24 is provided in this manner. Utilisation of the measurement additionally requires software procedures since, when the speed of rotation of the forming roll changes, the measurement also changes even though the distance would not change. This can be attended to by synchronising the measurement with the speed of rotation of the roll and by making calibration measurements with known values (distances, speeds of rotation). Compensation for the effect of the speed of rotation of the forming roll may be further improved by means of separate magnetometers which are situated at a known distance from the forming roll.

Figure 3:
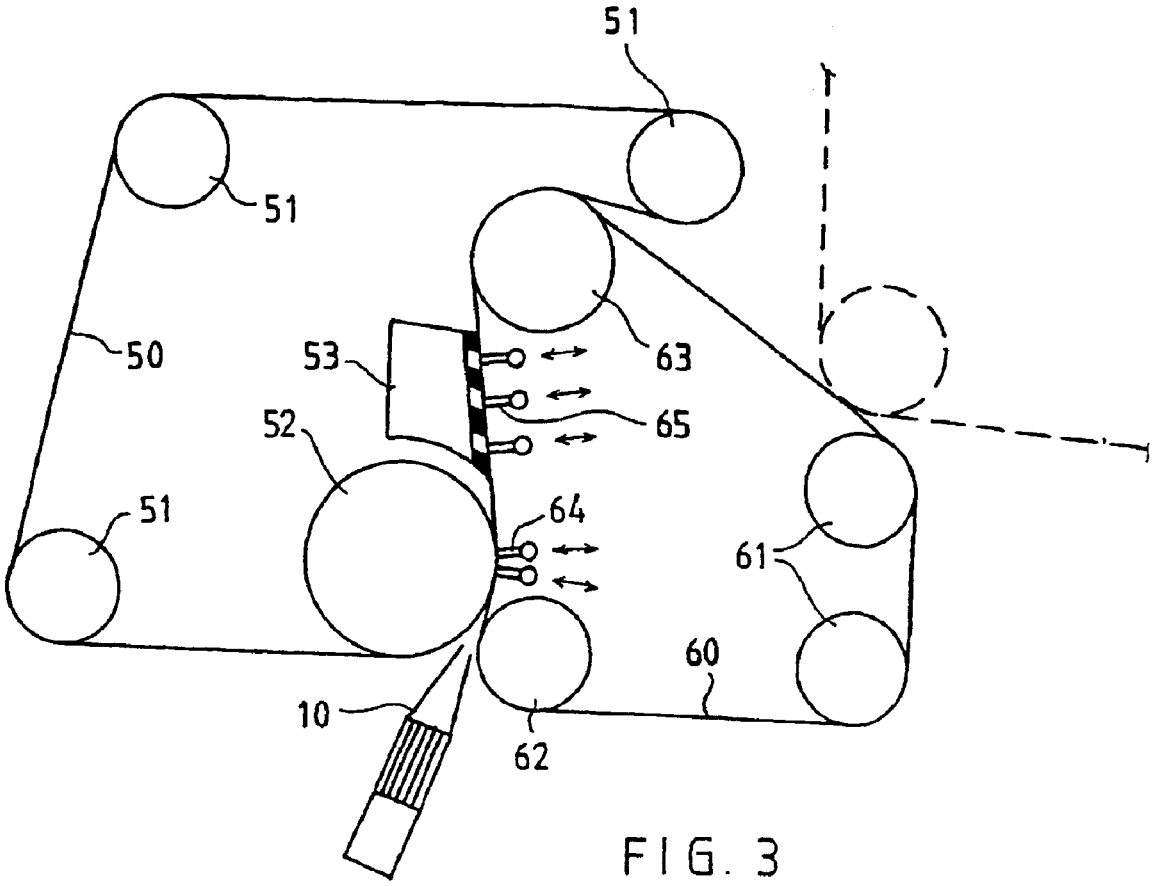
FIG. 3 shows another roll-gap former in which the method according to the invention can be applied.

FIG. 3 shows another roll-gap former in which the measurement and regulation of the dewatering profile in accordance with the invention can also be applied. The former comprises a first wire loop 50 guided by guide rolls 51 and by a first forming roll 52 as well as a second wire loop 60 guided by guide rolls 61, a breast roll 62 and a second forming roll 63. A stock suspension jet is discharged from a headbox 10 into a forming gap which is defined by the first wire 50 running over the forming roll 52 and by the second wire 60 guided by the breast roll 62. On a curve sector of the forming roll 52, the wires 50, 60 are loaded by means of blade elements 64, which have been placed within the second wire loop 60. The forming roll 52 is followed by a dewatering box 53 which has been placed inside the first wire loop 50 and which is opposed by a number of blade elements 65 which have been placed inside the second wire loop 60 and the load of which can be regulated. The joint run of the wires 50, 60 ends after a curve sector of the second forming roll 63.

In accordance with the invention, the distance between one loading blade 64 and the shell of the forming roll 52 and/or the distance between one loading blade 65 and the ribbed deck of the dewatering box 53 is/are measured in a contact-free manner in order to determine the thickness profile of the stock. The first measurement is advantageously accomplished such that both a current rail and magnetometers are placed in one loading blade/in the loading blades 64. At the dewatering box 53, the arrangement can be, for example, such that a current rail is placed in one loading blade 65 and magnetometers are placed in a dewatering blade in the ribbed deck of the dewatering box 53. When needed, the measurement can be performed at several successive locations in the former. It is essential that at the measurement point there are two dewatering elements or other blade elements on both sides of the web at a reasonable distance from each other, which elements are in contact with the wire and extend substantially across the entire web.

Based on the measurement of the dewatering profile, the location or position of the loading blades 64 and/or 65 is adjusted with respect to the forming roll 52 or the dewatering box 53. The load of the loading blades 64 and 65 can be regulated in a manner known in itself. The regulation can be carried out, for example, by means of a profiling hose which has been divided in the longitudinal direction into different compartments which can be provided with different pressures to produce different loads at different locations in the cross direction of the paper web. By regulating the linear pressure of the loading blade, it is possible to control, as known, different cross profiles of the web which is being formed, such as the profiles of dewatering, formation, distribution of fillers, retention and/or basis weight.

Figure 4:
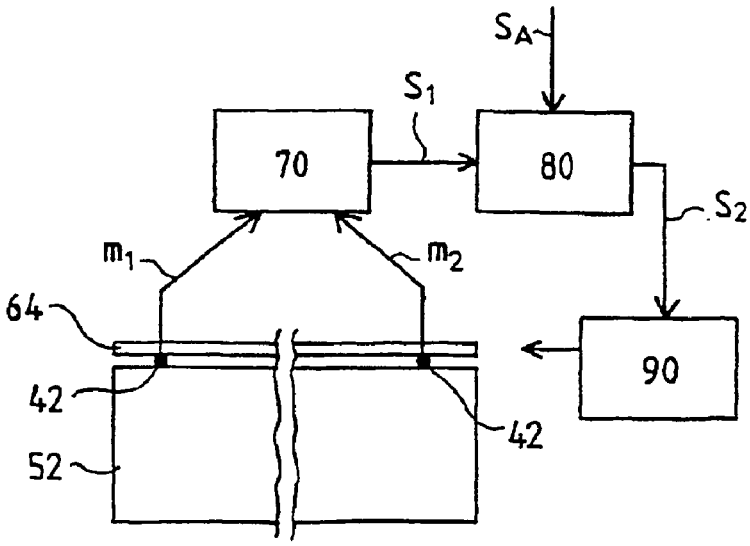
FIG. 4 schematically shows the principle of the regulation system according to the invention.

The general principle of the regulation method in accordance with the invention is schematically shown in FIG. 4. The distance between the forming roll 52 and the loading blade 64 is measured at at least two points in the width direction of the roll 52 by means of measuring devices 42, which have been shown here only by way of suggestion. There may, of course, be also more than two measuring points. The measurement method can be like the one described above based on measurement of the strength of a magnetic field or it can be another method known in itself suitable for contact-free measurement of distance. The measurement results $m_1$, $m_2$, . . . are passed to a computing unit 70 which computes based on them the profile of the flow channel defined between the forming roll 52 and the blade element 64. The computing unit 70 supplies a measurement signal $S_1$ representing the profile to a control unit 80 which compares it to a set value $S_A$. The control unit 80 produces a control signal $S_2$ for an actuator 90 which controls the location and/or the position of the loading blade 64 with respect to the forming roll 52.

The actuator 90 may comprise, for example, a number of valves coupled to pressure medium conduits for controlling admission of different pressures into the different compartments of the profiling hose loading the blade element. Alternatively, the actuator may comprise a valve which controls admission of a heating medium into a support structure of the blade element for regulating the deflection of the blade element in the cross direction of the web. A mechanical gear can also function as the actuator for inclining either the mere blade element or its entire support structure.

The invention is not desired to be confined to the embodiments described above only as examples, but its different applications are feasible within the scope of protection defined in the claims to be presented in the following.

What is claimed is:

1. A method for controlling the dewatering profile in a former of a paper or board machine, comprising the steps of:

removing water from a web between a first forming wire loop and a second forming wire loop, wherein dewatering elements are placed within the forming wire loops, at least one of which dewatering elements comprises a blade element which extends transversely across the web with respect to the running direction of the wires;

measuring the cross-direction profile of a flow channel defined between a first dewatering element situated inside the first forming wire loop and a second dewatering element situated inside the second forming wire loop; and adjusting the location and/or the position of the blade element based on the measurement result in order to regulate the thickness profile of a stock flow.

2. The method of claim 1 wherein the cross-direction profile of the flow channel defined between the first dewatering element and the second dewatering element is measured by passing an alternating current of low frequency to a current rail situated in the second dewatering element and by measuring the strength of the magnetic field created by said current by at least two measuring devices placed in connection with the first dewatering element.

3. The method of claim 1 wherein the first dewatering element comprises a forming roll, and the second dewatering element comprises the blade element, the blade element being in contact with the first forming wire on a curve sector, and the cross-direction profile of the flow channel defined between the forming roll and the blade element being measured by passing an alternating current of low frequency to a current rail situated in the blade element and by measuring the strength of the magnetic field generated by the rotation of the forming roll by at least two measuring devices placed in connection with said blade element.

4. The method of claim 1 wherein the cross-direction profile of the flow channel defined between two dewatering elements is measured at one or more locations in the former.

5. A method for controlling the dewatering profile in a former of a paper or board machine, comprising the steps of:

removing water from a web between a first forming wire formed into a first loop and a second forming wire formed into a second loop, wherein a forming roll is placed within the first forming wire loop, and a blade element is placed within the second forming wire loop, the blade element extending transversely across the web with respect to the running direction of the wires;

measuring the cross-direction profile of a flow channel defined between the forming roll and the blade element by passing an alternating current of low frequency through a current rail situated in the blade element and measuring the strength of the magnetic filed generated by the rotation of the forming roll by at least two measuring devices; and adjusting the location of the blade element based on the measurement result in order to regulate the thickness profile of a stock flow.

6. A regulation arrangement for controlling the dewatering profile in a former of a paper or board machine, the arrangement comprising:

a first forming wire loop;

a second forming wire loop, wherein the first forming wire loop and the second forming wire loop have dewatering elements placed inside them, wherein at least one os said dewatering elements comprises a blade element which extends transversely across the web with respect to the running direction of the forming wire loops and is in contact with one of the forming wire loops;

members for measuring the cross-direction profile of a flow channel defined between a first dewatering element situated inside the first forming wire loop and a second dewatering element situated inside the second forming wire loop; and members for adjusting the location and/or the position of the blade element based on the result of measurement of the profile of the flow channel.

7. The regulation arrangement of claim 6 wherein the members for measuring the cross-direction profile of the flow channel comprise a current rail which is situated in the first dewatering element and to which an alternating current of low frequency has been arranged to be passed, and at least two measuring devices attached to the second dewatering element for measuring the strength of the magnetic field created by the current rail.

8. The regulation arrangement of claim 6 wherein the first dewatering element comprises a forming roll, and the second dewatering element comprises the blade element, the blade element being in contact with the first forming wire on a curve sector, and further comprising:

members for measuring the cross-direction profile of the flow channel defined between the forming roll and the blade element, the members comprising a current rail which is situated in the blade element and to which an alternating current of low frequency has been arranged to be passed, and members for measuring the strength of the magnetic field generated by the rotation of the forming roll, which members comprise at least two measuring devices placed in connection with said blade element.

* * * * *